United States Patent [19]

Passmore et al.

[11] 4,012,659

[45] Mar. 15, 1977

[54] METHOD OF FLASHING TUNGSTEN FILAMENT

[75] Inventors: Edmund M. Passmore, Wilmington; George L. Duggan, Bedford; Warren A. Anderson, Danvers; William M. Labadini, Salisbury, all of Mass.

[73] Assignee: GTE Sylvania Incorporated, Danvers, Mass.

[22] Filed: Dec. 31, 1975

[21] Appl. No.: 645,486

[52] U.S. Cl. ..... 313/344; 313/341

[51] Int. Cl.[2] ..... H01J 1/16; H01K 1/14; H01J 19/10

[58] Field of Search ..... 313/341, 342, 343, 344

[56] References Cited

UNITED STATES PATENTS

| | | | |
|---|---|---|---|
| 2,225,239 | 12/1940 | Spaeth | 313/344 |
| 2,276,048 | 3/1942 | Laise | 313/344 X |
| 2,306,925 | 12/1942 | Aicher | 313/344 X |
| 2,371,205 | 3/1945 | Zabel | 313/344 X |
| 3,210,589 | 10/1965 | Mason | 313/341 X |

FOREIGN PATENTS OR APPLICATIONS

| | | | |
|---|---|---|---|
| 481,964 | 3/1938 | United Kingdom | 313/344 |

*Primary Examiner*—Saxfield Chatmon, Jr.
*Attorney, Agent, or Firm*—James Theodosopoulos

[57] ABSTRACT

The tungsten wire filament of an incandescent lamp is flashed to a recrystallized structure by applying pulses of electrical energy thereto.

1 Claim, 1 Drawing Figure

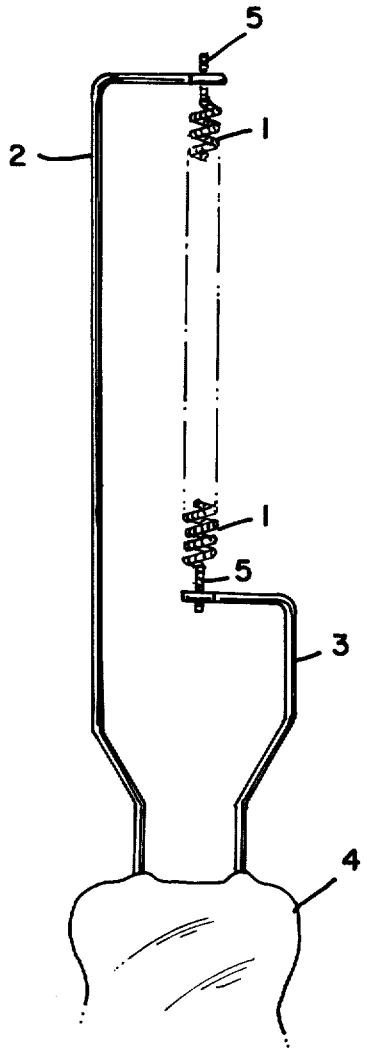
5
1
2
1
5
3
4

METHOD OF FLASHING TUNGSTEN FILAMENT

THE INVENTION

This information concerns incandescent lamps having coiled tungsten wire filaments.

The tungsten wire used for making coiled filaments has a fibrous structure which gives it the ductility required for the coiling operation. For satisfactory lamp life, the fibrous structure is converted into a nonsagging crystalline structure by heating the filament to the recrystallization temperature, as disclosed in U.S. Pat. Nos. 1,410,499, 2,325,239, 2,439,913, 2,832,661 and 3,285,293. Generally this is done at the first lighting of the sealed lamp and is called flashing.

One of the problems with prior art flashing processes is that the portions of the tungsten filament immediately adjacent the filament lead-in support wires are not heated to the recrystallization temperature and, therefore, are not converted to the desired nonsagging crystal structure. This is because the lead-in wires act as heat sinks and prevent said adjacent filament portions from attaining the recrystallization temperature.

We have found that if the filaments are flashed by application thereto of one or more pulses of electrical energy, as, for example, by means of a capacitor discharge (CD), then the tungsten is recrystallized much closer to the support wires than is possible by the prior art method of flashing, which prior art method involves heating the filament by the application thereto of a continuous voltage from a transformer operating off the usual AC power lines. The advantage of the closer recrystallization conferred by this invention is longer average lamp life. The reason may be that the recrystallized structure at the ends of the filament is less susceptible to chemical attack from contaminants within the lamp envelope than is the fibrous structure at the ends of prior art lamp filaments.

The single FIG. in the drawing is an enlarged view of a coiled tungsten filament mounted on support wires that can be flashed in accordance with this invention.

In one embodiment, coiled tungsten filament 1 is mounted between upper and lower support wires 2 and 3 which, in turn, are supported in glass stem press 4. The ends of support wires 2 and 3 are folded back on each other and clamped onto the ends 5 of filament 1 to support the filament and to provide electrical connection thereto.

In one example, for a 60 watt, 120 volt, 750 hour lamp, filament 1 comprised 536 mm of 1.8 ml diameter tungsten wire primary wound at 347 turns per inch (TPI) on a 4 mil mandrel and secondary wound at 49 TPI on a 12 mil mandrel. The body length of the finished coil was about 18 mm long and each leg was about 4½ mm long. Support wires 2 and 3, between which the filament was clamped, were made of 16 mil and 18 mil wire respectively.

Three gas filled 60 watt lamps, utilizing these filaments, were flashed in accordance with this invention by discharging a pulse of electrical energy from a 550 microfarad capacitor bank, previously charged to 275 volts, into each lamp individually. One pulse was used per lamp. The filaments were then metallographically examined and the number of uncrystallized primary coil turns, extending from the clamp toward the coil body, was counted. For the six filament ends so examined, the average number of uncrystallized primary turns was 1½, with a range of 0 to 3 turns. In all cases, recrystallization occurred within 16 mils of support wires 2 and 3. In contrast, in an equal number of identical lamps in which the filaments were flashed as per the prior art, the corresponding results were an average of 24 uncrystallized primary turns, with a range of 13 to 39 turns. The heat sink effect of the support wire is sufficient to prevent recrystallization within a distance equal to the breadth of the support wire, when the filament is flashed by prior art continuous voltage processes. The improvement of this invention in reducing the number of unrecrystallized turns exceeded an order of magnitude.

By means of a phototransistor light detector and a photometric sphere, an oscilloscope was used to record the temperature versus time cycles experienced by the 60 watt filaments during CD heating. Peak temperatures of 1200° to 3150° C and times to peak of 12 to 80 milliseconds were encompassed by means of energy inputs varying by an order of magnitude from 2.9 to 28 joules. For example, for an energy input of 28 joules, resulting from a 550 microfarad capacitor charged to 320 volts, the filament reached a peak temperature of 3150° C in about 40 milliseconds and was completely recrystallized. At a 250 volt charge, the 550 microfarad capacitor delivered an energy pulse of 17.2 joules which was also sufficient to completely recrystallize the filament. However, a 33 microfarad capacitor, charged to 500 volts, yielded a pulse of 4.1 joules, which was insufficient to recrystallize the filament.

Although these examples used a capacitor to supply the desired electrical pulse, other means may also be used, for example, a pulse transformer or a solid state switching device. In order to recrystallize the tungsten wire substantially closer to the supports than did prior art continuous voltage flashing processes, the electrical pulses should peak at less than about 100 or 200 milliseconds. Otherwise the rate of heating of the filament is not fast enough to alleviate the heat sink effect of the support wires.

1. In an incandescent lamp tungsten wire coiled filament the ends of which are attached to lead-in support wires, the improvement which comprises the filament having a recrystallized structure that extends closer to the support wires than the breadth of each support wire.

* * * * *